US005311098A

United States Patent [19]

Seely et al.

[11] Patent Number: 5,311,098

[45] Date of Patent: May 10, 1994

[54] INTERFERENCE PHOTOCATHODE

[75] Inventors: John F. Seely, Lorton; William R. Hunter, Springfield, both of Va.

[73] Assignee: The United States of America as represented by the Secretary of the Navy, Washington, D.C.

[21] Appl. No.: 888,083

[22] Filed: May 26, 1992

[51] Int. Cl.[5] ..... H01J 1/34; H01J 43/08

[52] U.S. Cl. ..... 313/542; 313/110; 313/539; 313/527; 250/214.1

[58] Field of Search ..... 313/542, 110, 111, 112, 313/539, 527; 250/214.1; 257/436

[56] References Cited

U.S. PATENT DOCUMENTS

| | | | |
|---|---|---|---|
| 3,638,059 | 1/1972 | Taylor . | |
| 4,196,257 | 4/1980 | Engstrom et al. | 313/542 |
| 4,614,871 | 9/1986 | Driscoll . | |
| 4,680,504 | 7/1987 | Helvy et al. . | |
| 4,698,496 | 10/1987 | Dolizy . | |

FOREIGN PATENT DOCUMENTS

| | | | |
|---|---|---|---|
| 0532358 | 3/1993 | European Pat. Off. | 313/542 |

OTHER PUBLICATIONS

J. F. Seely et al., "Thin-Film Interference Optics for Imaging the O II 834 A Airglow and Rejection of 1216 A Radiation," SPIE vol. 1546 Multilayer and Grazing IncidenceX-Ray/EUV Optics Jul. 1991.

J. F. Seely et al., "Thin FIlm Interference Optics for Imaging the O II 834-A Airglow," Applied Optics, 30, 2788 (No. 19, Jul. 1, 1991).

Greorg Hass, "Physics df thin films", vol. 1, Academic Press, 1963.

*Primary Examiner*—Donald J. Yusko
*Assistant Examiner*—Nimesh Patel
*Attorney, Agent, or Firm*—Thomas E. McDonnell; Edward F. Miles

[57] ABSTRACT

An interference photocathode includes a reflective substrate and interference layers disposed on said reflective substrate for selectively enhancing a first photoelectric yield of said photocathode when irradiated by radiation having a first wavelength relative to a second photoelectric yield of said photocathode when irradiated by radiation having a second wavelength. In one embodiment, the interference layers include a dielectric layer having a wavelength dependent effective thickness disposed on said reflective substrate such that said effective thickness for radiation having said first wavelength is an odd multiple of a quarter of said first wavelength and said effective thickness for radiation having said second wavelength is an even multiple of a quarter of said second wavelength. In another embodiment, the dielectric layer includes a layer of electrically conductive material and a dielectric material disposed between said layer of electrically conductive material and said reflective substrate.

28 Claims, 6 Drawing Sheets

INTERFERENCE PHOTOCATHODE

BACKGROUND OF THE INVENTION

1. Field of the Invention

The present invention relates to interference type photocathodes having coatings to selectively reject radiation at one frequency and selectively detect radiation at a nearby wavelength.

2. Description of Related Art

U.S. Pat. No. 4,614,871 to Driscoll discloses a photodiode constructed of a metal (e.g. nickel) that emits electrons only in response to far-UV radiation of 140 nanometers shorter wavelengths. A window (e.g. magnesium fluoride) is positioned at the entrance to the photodiode to filter out far-UV radiation with wavelengths shorter than 100 nanometers. Thus, the photodiode is sensitive to radiation in a wavelength range no greater than 100 to 140 nanometers, and its sensitivity to radiation outside that range is less than 10% of its maximum sensitivity within the range.

U.S. Pat. No. 3,638,059 to Taylor discloses a photometer that comprises two basic components: a window through which radiation passes, and a cathode which has a photoelectric surface that is excited by desired radiation that passes through the window. The window used in the Taylor photometer blocks out penetration of all visible and near ultraviolet, whereas the infrared and lower frequency radiation which is transmitted does not effect the cathode. Therefore, the structure is suitable for detecting radiation between 150 and 800 angstroms.

U.S. Pat. No. 4,680,504 to Helvy et al. discloses an electron discharge device with a photoemissive cathode which is disposed within an envelope for providing photoelectrons in response to radiation incident thereon. The device is improved by forming the face plate from an optical filter which transmits radiation predominantly in a first portion of the electromagnetic spectrum. Furthermore, the photoemissive cathode has an intrinsic responsivity extending from said first through a second portion of the spectrum. However, the combination of the filter face plate and the photoemissive cathode limits the tube to a responsivity within a spectral range of s id first portion of the electromagnetic spectrum U.S. Pat. No. 4,698,496 to Dolizy discloses a photoelectric detection device comprised of a vacuum chamber provided with a window having a substrate which bears a photocathode on the internal surface of the vacuum chamber. The device is sensitive to incident luminous radiation between a short wavelength bottom threshold $\lambda_1$ and a longer wavelength upper threshold $\lambda_2$. Variations in photoelectric power are connected with the composition and thickness of the layers, the probability of electron emission, and the topology of the surfaces, these parameters having a different effect according to the wavelength range of the incident beam. The invention of Dolizy suppresses the influence of the sensitivity threshold $\lambda_2$ of the detection device by filtering the incident light spectrum and suppressing this high threshold $\lambda_2$. This filter can be an interference filter constructed by a series of layers of material with high and low optical indices. For this purpose, a low pass filter (one which passes shorter wavelengths) is created which cuts off the longer wavelength for which the transmission of the low pass filter is perhaps in the region of 10%. Light passes through the interference filter producing at the outlet a light beam of which the wavelengths are limited in the upper part and possibly in the lower part according to characteristics of the filter(s) in the context of the invention. This beam of filtered wavelengths is absorbed in the photocathode to generate electrons emitted over the complete surface of the photocathode.

D. Kossel et al, Physics of Thin Films, edited by G. Hass and R. E. Thun, Academic Press, New York, 1969, describe coatings designed to absorb radiation at a particular wavelength.

BACKGROUND OF THE INVENTION

Plasmas that contain neutral hydrogen (H I) are strong sources of 1216 Å radiation. Such plasmas occur near the wall region of Tokamak fusion machines, in the solar atmosphere and in the earth's ionosphere and magnetosphere. These plasmas also contain other atomic species with lower abundances that radiate at much lower intensity levels than the neutral hydrogen emission. It is often desirable for diagnostic purposes to selectively detect or image radiation with a wavelength near 1216 Å while at the same time rejecting the intense 1216 Å radiation emitted by neutral hydrogen. This can be done by dispersing the radiation using a grating, but in this case the relatively low efficiency of the grating reduces the throughput of the instrument and raises the threshold sensitivity level that can be detected. An alternative is to use a detector that is sensitive to the desired radiation but insensitive to the 1216 Å radiation of neutral hydrogen. Such a detector could be used in combination with high-efficiency imaging optics and filters that are also wavelength selective.

A specific application is the imaging of the 834 Å singly ionized oxygen (O II) radiation from the earth's ionospheric F-region. The imaging of the 834 Å wavelength radiation is of interest for the determination of electron density profile and the prediction of the earth's electromagnetic environment. The 834 Å oxygen emission is also present in the magnetosphere, and its global imaging would provide a unique means of diagnosing solar-terrestrial disturbances. In the ionosphere, the 834 Å emission is typically a factor of 3000 weaker than the 1216 Å emission of neutral hydrogen. Prior art structures are unable to detect a desired signal that is so much weaker than undesired signals of close but different wavelengths.

SUMMARY OF THE INVENTION

It is an object of the present invention to selectively reduce sensitivity to radiation of one wavelength while selectively enhancing sensitivity to radiation of a second wavelength, different from the first wavelength, in a photocathode.

To achieve this and other objects made apparent hereinafter, the invention concerns a photocathode having a reflector for reflecting incident electromagnetic radiation, and an interference means for causing interference of electromagnetic radiation reflected from the reflector and incident electromagnetic radiation. The reflector and the interference mean are adapted to cause the interference to result in an electromagnetic field zero at or near the surface of the interference means for incident electromagnetic radiation at a first selected wavelength, and to cause an electromagnetic field maximum at or near the surface for a second preselected electromagnetic wavelength.

By so doing, the field produced by the first wavelength is strongest away from the surface of the interference means, and electrons ejected as a result of the field (by, e.g. the photoelectric effect) will not escape, and cannot contribute to photocurrent. Conversely, the field produced by the second wavelength is strongest at or near the surface, and electrons emitted responsive to this field readily escape and can contribute to detectable photocurrent. The photocathode is thus disproportionately sensitive to radiation at the second wavelength, and can detect or image at this wavelength even in the presence of strong radiation at the first wavelength.

BRIEF DESCRIPTION OF THE DRAWINGS

These and other object features, and advantages of the invention are further understood from the following detailed description of particular embodiments of the invention. It is understood, however, that the invention is capable of extended application beyond the precise details of these embodiments. Changes and modifications can be made to the embodiments that do not affect the spirit of the invention, nor exceed its scope, as expressed in the appended claims. The embodiments are described with particular reference to the accompanying drawings, wherein:

DESCRIPTION OF THE PREFERRED EMBODIMENTS

Figure 1:
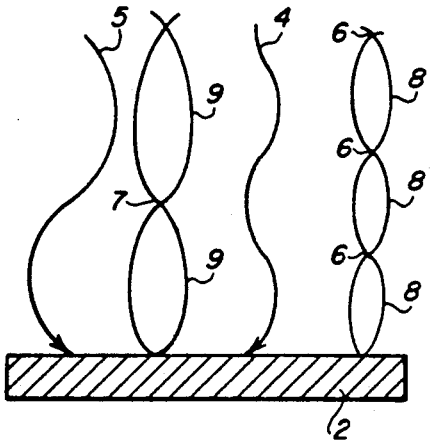
FIG. 1 is a schematic view of reflected waves of two different wavelengths creating standing waves with nodes and loops.

FIG. 1 illustrates electromagnetic waves 4 and 5 incident on reflective substrate 2. Reflected waves interfere with incident waves, and this interference causes a standing wave to result, characterized by a series of nodes (points of zero field strength) 6 and series of loops (points of maximum field strength) 8. The nodes of the series of nodes 6 are spaced from one another by one-half of the wavelength of incident radiation 4. The loops of the series of loops 8 are spaced from one another by one-half of the wavelength of incident radiation 4. A node of the series of nodes 6 is spaced from a corresponding loop of the series of loops 8 by one-quarter of the wavelength of incident radiation 4. The same descriptions apply to wave 5 which has a different wavelength than wave 4, and to the nodes 7 and loops 9.

Figure 2:
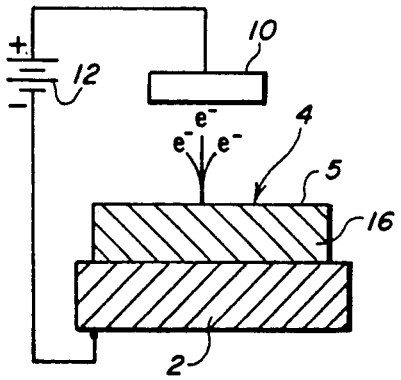
FIG. 2 is a schematic of a circuit for a first embodiment of the photocathode.

FIG. 2 is a circuit employing a first embodiment of the photocathode. The photocathode is comprised of reflective surface 2 and dielectric layer 16. Reflective surface 2 is charged negatively with respect to anode 10 by power source 12. Incident electromagnetic radiation 4 on the photocathode releases electrons e- from the surface thereof by the photoelectric effect. The electrons e- are attracted to the positive charge of anode 10 thus producing a current in response to incident radiation 4.

Dielectric layer 16 on reflective substrate 2 is of such a thickness that the optical distance of dielectric layer 16 at a first wavelength, for example 1216 Å, is an integral multiple of one-half of that wavelength, and that the effective thickness at a second wavelength, for example 834 Å, is an odd multiple of one-quarter of the second wavelength. Thus, at the first wavelength, the standing wave will have a node at the top surface of dielectric layer 16, while at the second wavelength, it will have a loop at the top surface of dielectric layer 16. This means that the electromagnetic field strength for radiation at the second wavelength will be high in the vicinity of surface 5 of dielectric 16, where the field will cause emission of a considerable photocurrent. Conversely, the field strength for radiation at the first wavelength will be relatively low at surface 5, and relatively high in the interior of dielectric 16. Thus most of the photoelectrons created by radiation at the first wavelength occur in the interior of dielectric 16, where they are trapped and cannot contribute to photocurrent. Because of this, the device of FIG. 2 is far more sensitive to radiation of the second wavelength than to radiation of the first wavelength.

Figure 5:
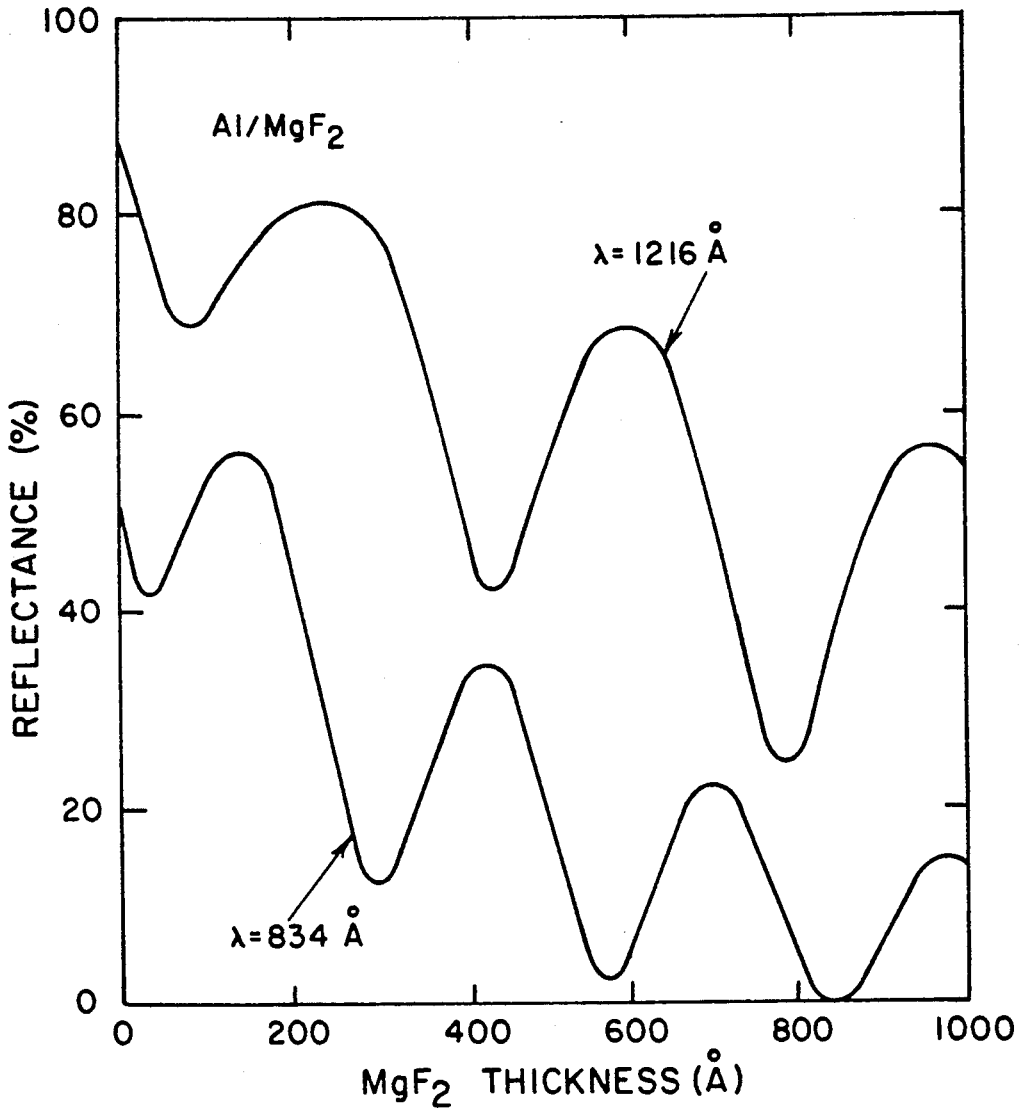
FIG. 5 is a graph illustrating calculated reflectance of unoxidized aluminum at two incident wavelengths for a varying thickness of a $MgF_2$ coating.

FIG. 5 illustrates how one can select the thickness of dielectric 16. FIG. 5 is a plot of reflectance at 834 Å and 1216 Å wavelengths, of an unoxidized aluminum reflector with a dielectric layer of $MgF_2$, as a function of dielectric thickness. The curves in FIG. 5 were calculated from first principles. As FIG. 5 shows, in the vicinity of 220 Å thickness of means for $MgF_2$ the reflectance of 1216 Å radiation is high, and that of 834 Å low. The same is true at about 580 Å thickness, and the reverse is true at about 420 Å thickness. As is commonly known, a field loop corresponds to low reflectance, and a node to high reflectance. It will be appreciated that a thickness of $MgF_2$ may be selected using FIG. 5 to maximize reflectance of radiation at a 1216 Å wavelength and also minimize reflectance (i.e. maximize photoelectric yield) of radiation at a 834 Å wavelength by simply identifying at what thickness a reflectance maximum for 1216 Å coincides with a reflectance minimum for 834 Å radiation. Examples are 240 Å and 580 Å thicknesses of $MgF_2$.

Figure 3:
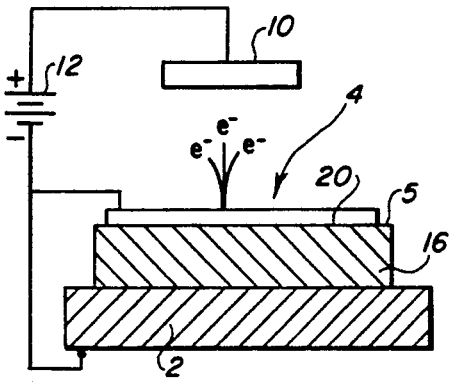
FIG. 3 is a schematic of a circuit for a second embodiment of a photocathode.

Because layer 16 is dielectric, only a limited number of electrons can be emitted from surface 5 before layer 16 charges, and photoemission stops. For this reason, it is advantageous to put a layer of conductive material at surface 5. FIG. 3 shows a device like that of FIG. 2, but with an additional layer 20 of electrically conductive material. Valence electrons in conductors are both plentiful and weakly bound. Thus placing layer 20 at surface 5, where the field strength of the desired wavelength is high, increases photoelectric yield, and hence increases device sensitivity yet further. In the example using $MgF_2$, photoemission will be enhanced at a wavelength of 834 Å because the majority of photoelectrons are released close to surface 5, 20, but reduced at a wavelength of 1216 Å because the release of photoelectrons occurs in the interior of layer 16, further from the surface 5, 20. In operation, radiation incident on the photocathode penetrates absorption layer 20 and spacer (dielectric) layer 16 and is reflected by reflective substrate 2 so as to form a standing wave. The thickness of spacer layer 16 and absorption layer 20 are designed so that radiation of a first wavelength will cause a standing wave having a node in absorption layer 20 while radiation of a second wavelength will form a standing wave having a loop at absorption layer 20. Electrons released interior to dielectric 16, distant from layer 20, will be released by the photoelectric effect at depths interior to spacer layer 16 and will not migrate to anode 10. On the other hand, electrons released because of the high field strength of the standing wave formed by incident radiation of the second wavelength at layer 20 will readily be released by the photoelectric effect in absorption layer 20, will migrate to the surface, and will be attracted to the positive charge on anode 10 provided by power source 12. The electrons so released will form a current which may be sensed in the circuit comprising anode 10, power source 12, absorption layer 20 and the drift space between absorption layer 20 and anode 10.

Figure 6A:
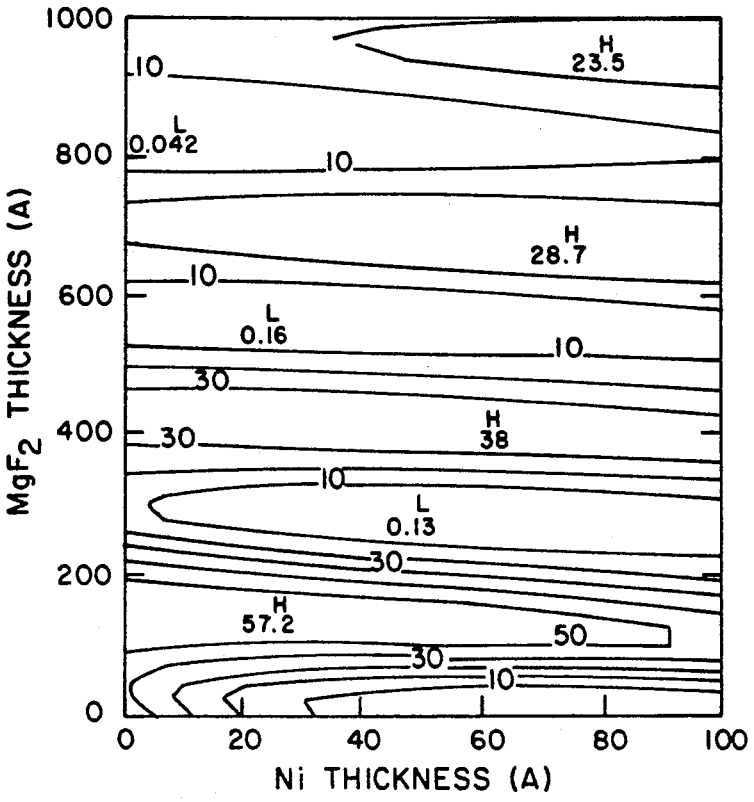
FIG. 6A is contour plots of calculated reflectance, at a wavelength of 834 Å, of an unoxidized aluminum mirror substrate having on it varying thickness combinations of $MgF_2$ and nickel coatings.
Figure 6B:
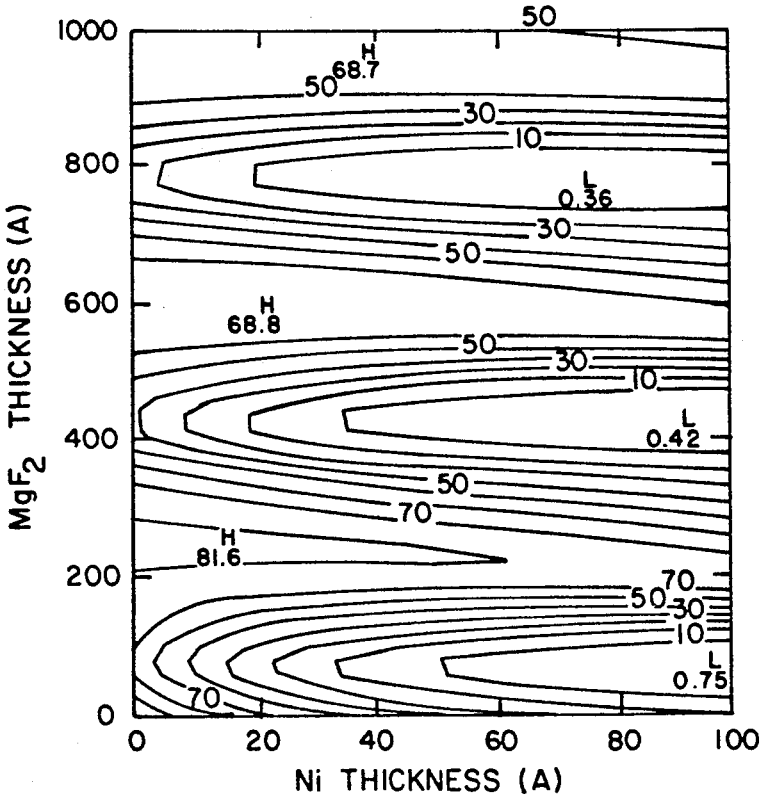
FIG. 6B shows contour plots like those of FIG. 6A, but for 1216 Å incident radiation.

The choice of metal for layer 20 is critical. As an example, calculations have shown that an overcoat of heavy metal, such as tungsten, affects the properties of members 2 and 16 such that reflectance maxima and minima for radiation of 1216 Å and 834 Å no longer coincide. However, calculations have shown that favorable coincidence occurs with lighter metals such as nickel or oxidized aluminum for coating thicknesses of 25–75 Å. FIGS. 6A and 6B illustrate this. The lines on FIGS. 6A and B represent combinations of $MgF_2$ thickness, and Ni thickness, that produce constant reflectance. The large numbers superimposed on particular lines indicate reflectance (in percent) to which the lines correspond. The letters H and L indicate maxima and minima (H--high, for a maximum, L--low, for a minimum), and the small numbers indicate reflectance (in percent) corresponding to the maxima and minima. FIG. 6A shows contour plots of the calculated normal-incidence percentage reflectance for radiation having a wavelength of 834 Å, for an interference photocathode coating composed of varying thicknesses of $MgF_2$ and nickel deposited onto unoxidized aluminum. FIG. 6B shows contour plots of the calculated normal-incidence percentage reflectance of radiation having a wavelength of 1216 Å of an interference photocathode coating composed of varying thicknesses of $MgF_2$ and nickel deposited onto unoxidized aluminum. An optimal $MgF_2$ spacer thickness can be determined from FIGS. 6A and 6B. For instance, a $MgF_2$ thickness of 225 Å will produce a first order relative maximum reflectance of radiation having a wavelength of 1216 Å and a relative minimum reflectance for radiation having a wavelength of 834 Å. A second order optimum design has a $MgF_2$ thickness of 580 Å. It will be appreciated that different contour plots may be produced corresponding to different spacer and nodal materials, and analyzed similarly, within the scope of the invention.

Figure 7:
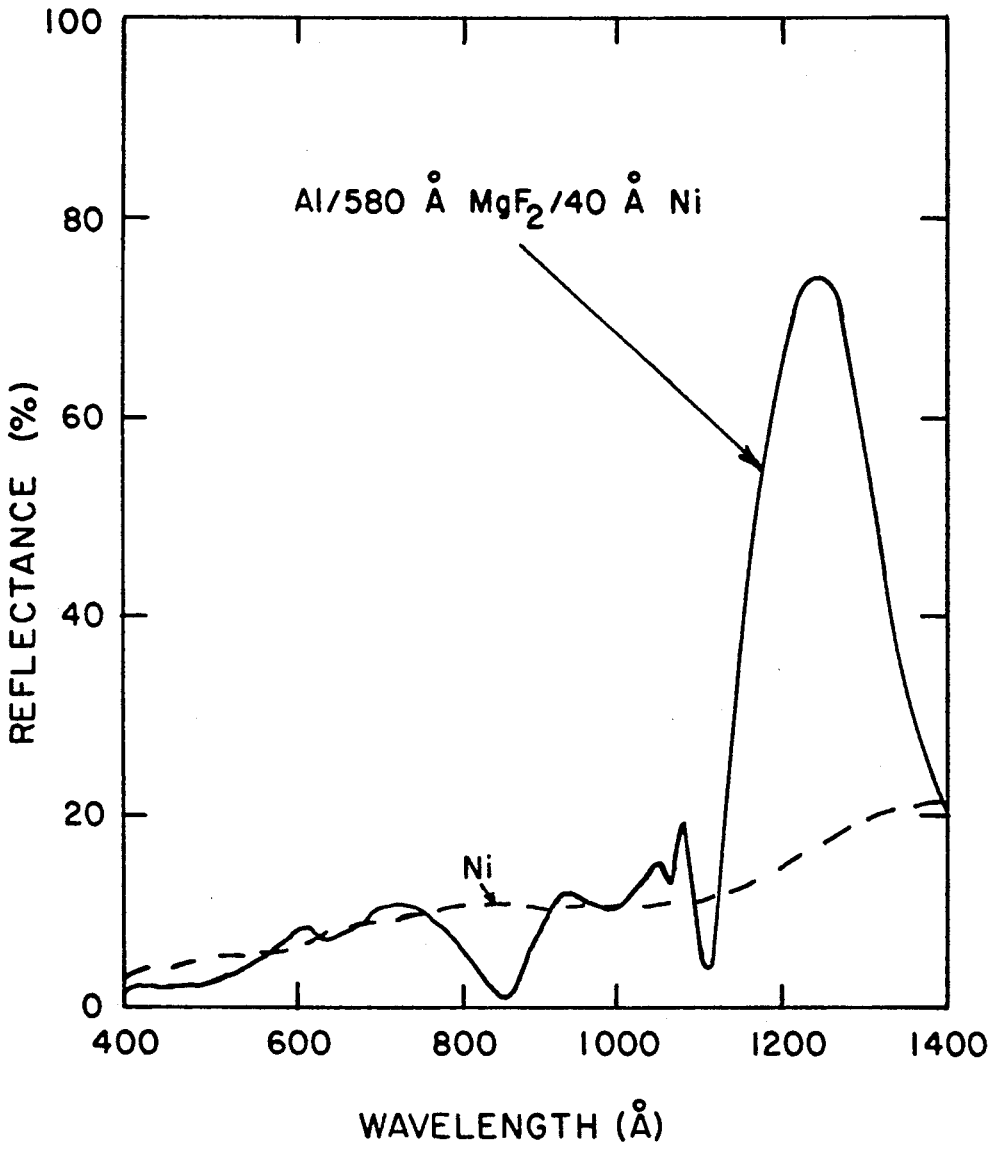
FIG. 7 is a graph of calculated reflectance for a combination photocathode, and for opaque nickel, as a function of wavelength.

FIG. 7 shows the calculated reflectance of an interference photocathode comprised of a 580 Å thick $MgF_2$ layer and a 40 Å thick nickel layer (solid lines), and that of nickel alone (dashed line). As can be seen in FIG. 7, the reflectance of the interference photocathode is maximized for radiation having a wavelength of about 1216 Å and minimized for radiation having a wavelength of search 834 Å. The reflectance of the interference photocathode for radiation having a wavelength of 834 Å is 1%, which is appreciably smaller than the reflectance of opaque nickel to radiation having the same wavelength thus indicating an appreciably greater photoelectric yield. In the case of the interference photocathode, the photoelectrons are created at the surface layer and the photoelectric yield of the interference coating is expected to be higher as compared to the photoelectric yield of opaque nickel wherein the photoelectrons are excited deeper within the metal and cannot escape. However, the reflectance of the interference photocathode to radiation having a wavelength of 1216 Å is a factor of 4 times larger than the reflectance of opaque nickel to radiation having the same wavelength. Accordingly, the photoelectric yield of the interference photocathode to radiation having a wavelength of 1216 Å is expected to be approximately a factor of 4 times smaller than the photoelectric yield of opaque nickel to radiation having the same wavelength. The photoelectric yield of the aluminum-$MgF_2$-nickel interference photocathode can be estimated by multiplying the photoelectric yield of opaque nickel by the absorbance of the interference coating and the dividing by the absorbance of the opaque nickel.

Figure 4:
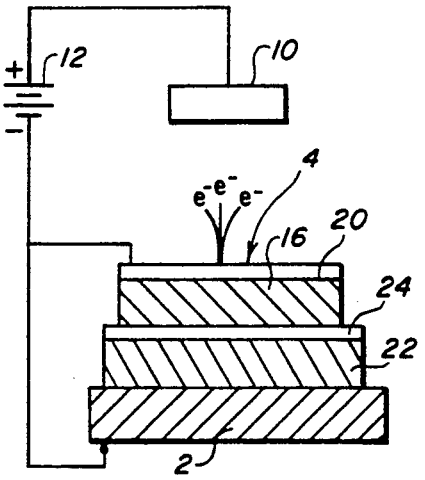
FIG. 4 is a schematic of a circuit for a third embodiment of the photocathode.

FIG. 4 is a circuit employing a third embodiment of the interference photocathode. The interference photocathode comprises reflecting substrate 2, first spacer (dielectric) layer 16, first thin absorption (conducting) layer 20, and one or more second spacer (dielectric) layers 22 and second thin absorption (conducting) layers 24 intercalated between the reflective substrate 2 and first spacer layer 16. It will be appreciated that the thickness of first spacer layer 16 and second spacer layers 22 are selected in substantially the same way as a corresponding thickness for spacer layer 16 was selected in the second embodiment shown in FIG. 3. It will be appreciated that second absorption layers 24 are intercalated in the interference photocathode to provide further enhancement of the standing waves. The interference photocathode is optimized for photoelectric yield to radiation having a wavelength such that, for a first (undesired) wavelength, field strength is minimum at both of layer 20, 24, and for a second (desired) wavelength, field strength is maximum at both layers 20, 24. Layer 24 permits a large release of electrons responsive to the second (desired) wavelength, which reinforces the standing wave of the second wavelength. This offsets attenuation of the second wavelength internal to layer 16, 22, and thus permits all the layers to be thicker, and, e.g., operate at higher power.

The selection of thicknesses for layers 16, 22 can proceed much as was done for the embodiments of FIGS. 1–2. Layers 16, 20, 22, 24 form, in effect, an optical transmission line having series dielectrics 16, 22 interleaved with conductors 20, 24. Typically, one would determine form first principles the electromagnetic field equations within the device, generate curves such as are shown in FIGS. 6 for layers 22, 24, identify thicknesses of layer 22 which result in attractive coincidences of a reflectance maximum for a desired wavelength and a reflectance minimum for an undesired wavelength, and then, using these coincidences as boundary conditions, repeat the process for layers 16, 20. It will be appreciated that other wavelength selective filters may be formed on the interference photocathode in accordance with the teachings of this disclosure. An example is LiF, whose mass and optical properties are similar to $MgF_2$. Metals with atomic numbers near that of Ni can be used for photoemission layers. Our calculations indicate that an alternative embodiment of the photocathode which would work well is one made of 110 Å of $MgF_2$ dielectric on an unoxidized aluminum substrate, with an 80 Å emissive layer atop the $MgF_2$.

Figure 8:
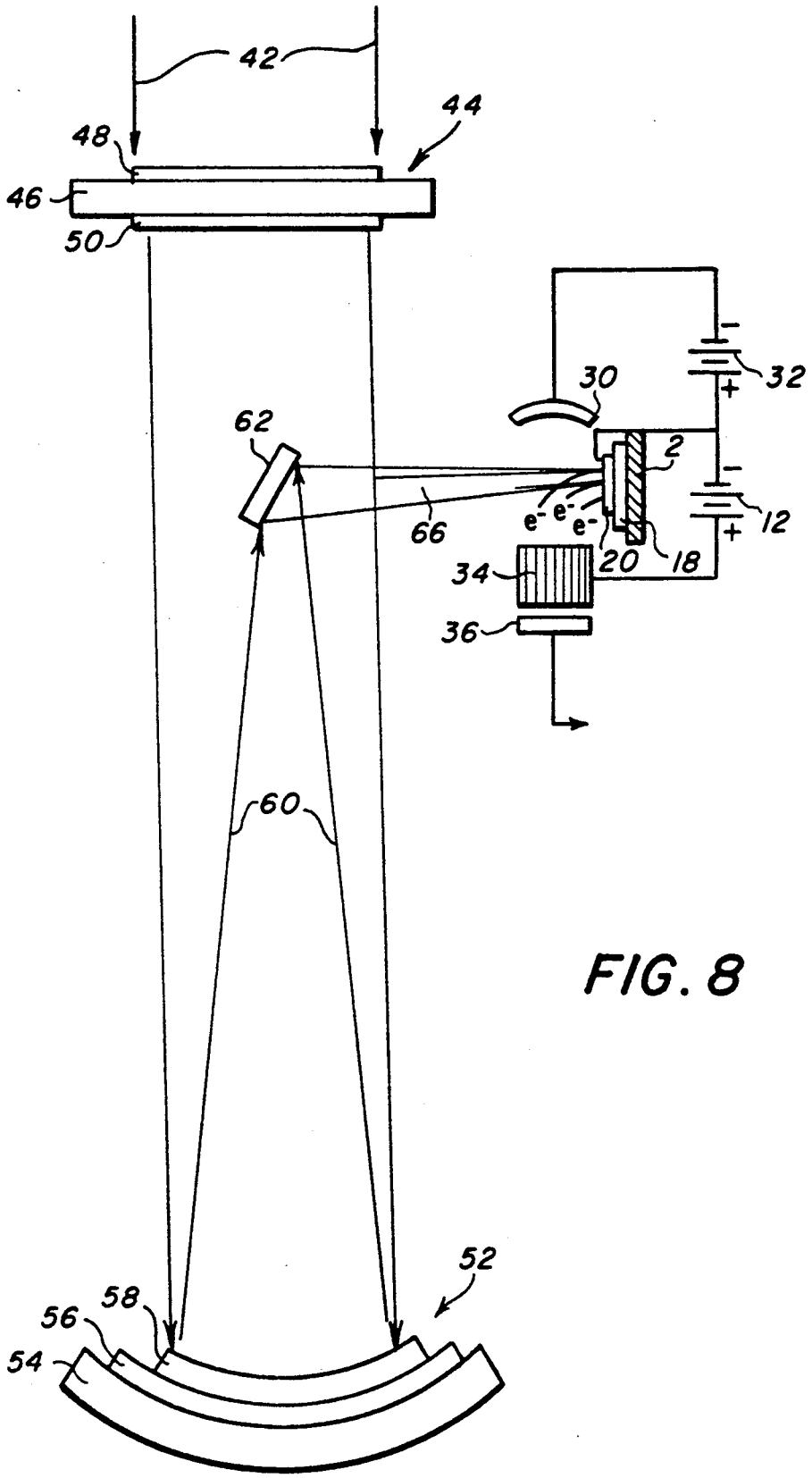
FIG. 8 is a schematic view of an interference photocathode detection system.

FIG. 8 shows a typical interference photocathode detection system employing the interference photocathode. Incident radiation 42 from a distance is received at the detection system of FIG. 8 and transmitted through interference filter 44 comprised of a plurality of dielectric layers 46, 48 and 50. For example, an interference filter may be formed comprising layer 46 of $MgF_2$ and layers 48, 50 of indium. Incident radiation 42 is reflected from interference mirror 52 comprised of a plurality of layers 54, 56 and 58 and focused into converging beam 60. For example, interference mirror 52 may be formed comprising reflecting substrate 54 of aluminum, spacer layer 56 of $MgF_2$, and layer 58 of silicon. Interference mirror 52 and sub-reflecting mirror 62 form an optic system to collimate incident radiation 42 into radiation beam 66. Radiation beam 66 transmits onto an interference photocathode comprised of mirror 2, dielectric 18, and conductor 20. The entire system is enclosed in a vacuum. The detection system of this example further comprises reflector or repeller 30, microchannel plate intensifier 34, and position-sensitive detector 36 such as a CCD. Power source 12 applies a negative charge to absorption layer 20 relative to the positive charge applied to microchannel plate intensifier 34, which functions in an equivalent role to the anode 10 of the second embodiment. Power source 32 applies a negative charge to repeller 30 relative to absorption layer 20 of the interference photocathode so that electrons yielded from absorption layer 20 as a result of radiation beam 66 on the interference photocathode, will be repelled from 30 and toward microchannel plate intensifier 34. Microchannel plate intensifier 34 functions as a electron multiplier in that electrons yielded from absorption layer 20 enter microchannels in the plate intensifier, where a number of electrons are increased by a multiplication effect. Electrons exiting the microchannel plate intensifier impinge on position-sensitive detector 36.

In operation, interference filter 44 selectively enhances radiation at a desired wavelength of 834 Å may be so enhanced. Radiation transmitted through interference filter 44 reflects from interference mirror 52. Interference mirror 52 selectively enhances radiation at a desired wavelength relative to other wavelengths. Finally, radiation beam 66 impinges on an interference photocathode which selectively enhances radiation at a desired wavelength and selectively reduces undesired radiation at a different wavelength.

Figure 9:
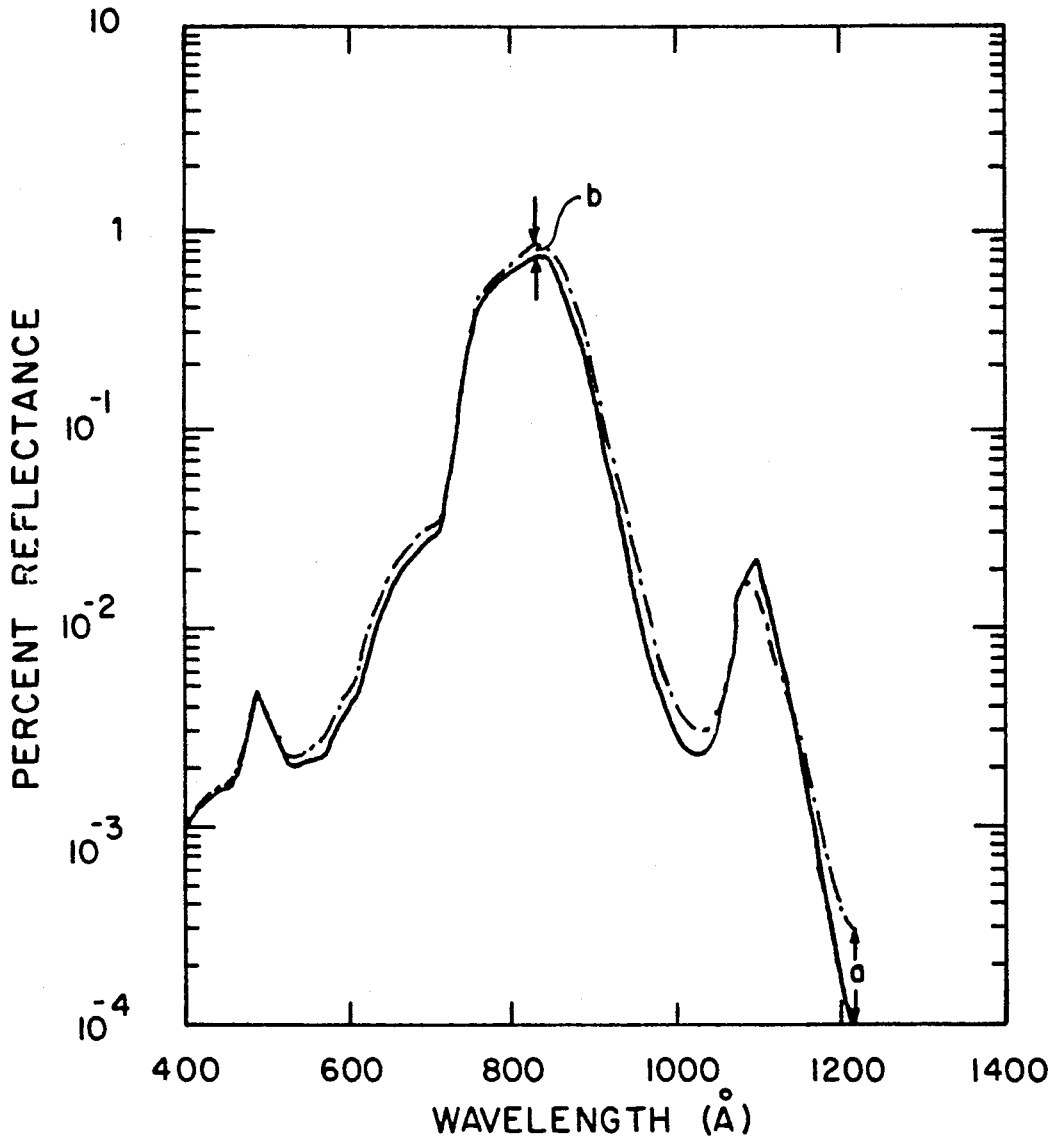
FIG. 9 is a graph illustrating the performance of the interference photocathode detection system.

FIG. 9 shows calculations indicating the performance of an interference photocathode in a detection system like that of FIG. 8. For the calculations of FIG. 9, mirror 52 is constituted by a 580 Å layer 18 of $MgF_2$ on an aluminum substrate 2, with 40 Å of nickel 20 atop the $MgF_2$. The dot-dashed curve is the product; of mirror 52's reflectance, filter 44's transmittance, and the photoelectric yield of a simple tungsten photocathode. On the other hand, the solid curve is the product of mirror 52's reflectance, the filter transmittance, and the estimated reflectance of the aluminum-$MgF_2$-nickel interference photocathode 2, 18, 20. It will be appreciated that the composite photoelectric yield as shown by the solid curve in FIG. 9 shows an appreciable reduction in photoelectric yield to radiation having a wavelength of 1216 Å, owing to the interference type photocathode. (E.g. the ratio of $a/b >> 1$.) The photoelectric yield of the detector to radiation having a wavelength of 1216 Å is a factor $10^4$ smaller than the photoelectric yield to radiation having a wavelength of 834 Å, which is sufficient for imaging the ionospheric 834 Å wavelength emission of singly ionized oxygen in a background of neutral hydrogen.

The interference photocathode as described herein has advantages over prior art structures including reducing the photoelectric yield to radiation having a wavelength of 1216 Å over the photoelectric yield to radiation having a wavelength of 834 Å by a factor of 4 or more when compared to a bare metal cathode. These and other advantages will be appreciated from the disclosure herein.

The invention has been described with reference to its preferred embodiments which are intended to be illustrative and not limiting. Various changes may be made without departing from the spirit and scope of the invention as defined in the following claims.

What is claimed is:

1. An interference photocathode comprising:

a reflective substrate; and interference means disposed on said reflective substrate for selectively enhancing a first photoelectric yield of said photocathode when irradiated by radiation having a first wavelength relative to a second photoelectric yield of said photocathode when irradiated by radiation having a second wavelength; and wherein said interference means comprises a coating having a thickness and an active surface opposite to a surface in contact with said reflective substrate such that said interference means enhances a first wave amplitude at said active surface by constructive interference of radiation having the first wavelength and suppresses a second wave amplitude at said active surface by destructive interference of radiation having the second wavelength.

2. An interference photocathode comprising:

a reflective substrate; and interference means disposed on said reflective substrate for selectively enhancing a first photoelectric yield of said photocathode when irradiated by radiation having a first wavelength relative to a second photoelectric yield of said photocathode when irradiated by radiation having a second wavelength; and wherein said interference means comprises a layer disposed on said reflective substrate such that the effective thickness of said interference means for radiation having said first wavelength is an odd multiple of a quarter of said first wavelength and an effective thickness for radiation having said second wavelength is an even multiple of a quarter of said second wavelength.

3. The interference photocathode of claim 2, wherein said reflective substrate comprises unoxidized aluminum and said layer of small absorbance comprises one of $MgF_2$ and LiF.

4. The interference photocathode of claim 2, wherein said layer of small absorbance comprises a layer of electrically conductive material and a material of small absorbance disposed between said layer of electrically conductive material and said reflective substrate.

5. The interference photocathode of claim 4, wherein said electrically conductive material comprises one of nickel and oxidized aluminum.

6. The interference photocathode of claim 4, wherein said layer of electrically conductive material has a thickness between 25 and 75 Angstroms.

7. The interference photocathode of claim 4, wherein said electrically conductive material is nickel and is about 40 Angstroms thick and wherein said material of small absorbance is $MgF_2$ and is one of about 225 and about 580 Angstroms thick.

8. An interference photocathode comprising:

a reflective substrate; and interference means disposed on said reflective substrate for selectively enhancing a first photoelectric yield of said photocathode when irradiated by radiation having a first wavelength relative to a second photoelectric yield of said photocathode when irradiated by radiation having a second wavelength; and wherein said first photoelectric yield is at least 1000 times greater than said second photoelectric yield when said first and second wavelengths are 834 and 1216 Angstroms, respectively.

9. An interference photocathode sensor comprising:

interference means for selectively enhancing a photoelectric yield of a cathode when irradiated by radiation having a first wavelength relative to a photoelectric yield of said cathode when irradiated by radiation having a second wavelength; and detector means for detecting electrons yielded from said cathode; and wherein said interference means is an interference coating comprising alternating layers of electron emissive material and dielectric material.

10. The sensor of claim 9, wherein said first wavelength is 834 Angstroms and said second wavelength is 1216 Angstroms.

11. The sensor of claim 9, wherein said first wavelength is a wavelength of radiation emitted from a plasma of singly ionized oxygen and said second wavelength is a wavelength emitted from a plasma of neutral hydrogen.

12. The sensor of claim 9, wherein said electron emissive material absorbs radiation to an extent greater than said dielectric material absorbs radiation.

13. The sensor of claim 9, wherein said electron emissive material is electrically conductive.

14. The sensor of claim 13, wherein said electron emissive material is between 25 and 75 Angstroms thick.

15. The sensor of claim 9, wherein said electron emissive material is nickel and is about 40 Angstroms thick and wherein said dielectric material is $MgF_2$ and is one of about 225 and about 580 Angstroms thick.

16. The sensor of claim 9, wherein said electron emissive material comprises one of nickel and oxidized aluminum.

17. The sensor of claim 9, wherein said sensor further comprises a microchannel plate intensifier, and wherein said detector means is a charge coupled detector.

18. An interference photocathode comprising:

a reflective substrate; and interference means disposed on said reflective substrate for selectively enhancing a first photoelectric yield of said photocathode when irradiated by radiation having a first wavelength relative to a second photoelectric yield of said photocathode when irradiated by radiation having a second wavelength;

wherein said interference means comprises a first layer and at least one second layer disposed between said first layer and said reflective substrate, wherein said first and second layers have a wavelength dependent composite effective thickness such that a composite effective thickness of said interference means for radiation having said first wavelength is an odd multiple of a quarter of said first wavelength and a composite effective thickness of said interference means for radiation having said second wavelength is an even multiple of a quarter of said second wavelength.

19. The interference photocathode of claim 18, wherein:

a second layer of said at least one second layer of small absorbance has two surfaces, a first surface of said two surfaces being disposed at a further distance from said reflective substrate than a second surface of said two surfaces, and wherein a distance measured from said first surface to said reflective substrate is such that an effective thickness of said distance for radiation having said first wavelength is an even multiple of a quarter of said first wavelength and an effective thickness of said distance for radiation having said second wavelength is an even multiple of a quarter of said second wavelength.

20. The interference photocathode of claim 19, wherein said first layer comprises a layer of electrically conductive material and a material disposed between said layer of electrically conductive material and at least one of said at least one second layer.

21. The interference photocathode of claim 19, wherein said second layer of said at least one second layer comprises a layer of electrically conductive material disposed adjacent to said first surface and a material disposed between said layer of electrically conductive material and said second surface.

22. A photocathode comprising:

reflection means for reflecting incident electromagnetic radiation;

interference means for causing interference of electromagnetic radiation reflected from said reflection means and said incident electromagnetic radiation, said interference means having a surface;

wherein said reflection means and interference means are adapted to cause said interference to produce an electromagnetic field zero substantially at said surface for incident electromagnetic radiation at a first selected wavelength, and to produce an electromagnetic field maximum substantially at said surface for a second preselected electromagnetic wavelength.

23. The photocathode of claim 22, wherein said reflector means is a mirrored substrate, and said interference means comprises $MgF_2$.

24. The photocathode of claim 22, wherein said interference means comprises a layer of electromagnetic conducting material located at said surface.

25. The photocathode of claim 24, wherein said conducting material comprises Ni.

26. The photocathode of claim 22, wherein said reflector means comprises a layer of aluminum.

27. The photocathode of claim 23, wherein said interference means comprises a layer of electromagnetic conducting material located at said surface; said conducting material comprises Ni; and said reflector means comprises a layer of aluminum.

28. The photocathode of claim 24, wherein said conducting material comprises Si.

* * * * *